US011873657B1

(12) United States Patent
Yanes et al.

(10) Patent No.: US 11,873,657 B1
(45) Date of Patent: Jan. 16, 2024

(54) POOLSIDE CADDY

(71) Applicants: Sarah Yanes, Homestead, FL (US); Ralph Yanes, Homestead, FL (US)

(72) Inventors: Sarah Yanes, Homestead, FL (US); Ralph Yanes, Homestead, FL (US)

( * ) Notice: Subject to any disclaimer, the term of this patent is extended or adjusted under 35 U.S.C. 154(b) by 0 days.

(21) Appl. No.: 17/860,385

(22) Filed: Jul. 8, 2022

(51) Int. Cl.
*E04H 4/14* (2006.01)

(52) U.S. Cl.
CPC ..... *E04H 4/14* (2013.01)

(58) Field of Classification Search
CPC ..... E04H 4/14
USPC ..... 4/496, 488
See application file for complete search history.

(56) References Cited

U.S. PATENT DOCUMENTS 4,903,926 A * 2/1990 McNarry ..... E04H 4/14 4/496
5,860,171 A * 1/1999 Hicks ..... E04H 4/14 4/496
6,474,244 B1 * 11/2002 Karpinski ..... E04H 4/14 108/42
6,705,235 B1 * 3/2004 Gerutto ..... A47B 5/00 108/47
6,748,874 B2 * 6/2004 Gawronski ..... A47B 23/025 108/42
6,862,755 B1 * 3/2005 Crachy ..... E04H 4/14 4/496
6,931,998 B1 * 8/2005 Leese ..... A47B 23/02 108/42
D534,368 S 1/2007 Karpinski
7,284,735 B1 * 10/2007 Khosropour ..... A47G 23/0225 248/205.5
7,386,896 B2 * 6/2008 Spicer ..... E04H 4/14 4/496
D618,968 S 7/2010 Belden
8,783,765 B1 * 7/2014 Matus ..... A47D 1/10 4/578.1
9,113,735 B1 * 8/2015 Jansma ..... A47G 23/0208
9,132,783 B2 * 9/2015 Brown ..... B60R 9/06
9,192,214 B2 * 11/2015 Gambill ..... A45B 23/00
D746,933 S 1/2016 Arnold
9,357,839 B1 * 6/2016 Liu ..... A47B 5/02
9,410,341 B1 * 8/2016 Welch ..... E04H 15/34
9,428,958 B1 * 8/2016 Ellis ..... E06C 7/14
9,609,100 B2 * 3/2017 Litterello ..... H04M 1/04
(Continued)

FOREIGN PATENT DOCUMENTS

BR 202019017964 U2 * 3/2021 ..... E04H 4/14
CA 2244413 A1 * 2/2000 ..... E04H 4/14

*Primary Examiner* — Lori L Baker
(74) *Attorney, Agent, or Firm* — Cramer Patent & Design PLLC; Aaron R. Cramer

(57) ABSTRACT

The poolside caddy may have an enclosure, one or more cup holders, and one or more phone holders. The poolside caddy may be a container for holding one or more beverage containers, one or more personal electronic devices, or both at a pool side venue. The poolside caddy may be placed at an edge of an inground pool where the one or more beverage containers and the one or more personal electronic devices may be adapted to be accessible by a user while the user is in the inground pool. The poolside caddy may be configured to prevent the one or more beverage containers and the one or more personal electronic devices from being knocked into the inground pool. The poolside caddy may be weighted to prevent the poolside caddy from moving.

15 Claims, 6 Drawing Sheets

(56) References Cited

U.S. PATENT DOCUMENTS

| | | | | |
|---|---|---|---|---|
| 9,814,305 | B2 * | 11/2017 | Brus | A47G 7/044 |
| 10,336,407 | B2 * | 7/2019 | Kennedy | B63B 21/20 |
| 10,362,862 | B2 * | 7/2019 | Symalla | A47B 5/02 |
| 10,477,960 | B1 * | 11/2019 | Johnson | A47B 5/02 |
| 10,662,706 | B2 * | 5/2020 | Heffernan | E04G 5/003 |
| D886,490 | S | 6/2020 | Johnson | |
| 10,687,616 | B2 * | 6/2020 | Brennan | A47B 13/003 |
| 11,199,211 | B2 | 12/2021 | Huang et al. | |
| 11,311,103 | B1 * | 4/2022 | Wilson | A47B 9/00 |
| 2002/0104157 | A1 * | 8/2002 | Wheaton | E04H 12/2261 4/496 |
| 2006/0265802 | A1 * | 11/2006 | Spicer | E04H 4/14 4/492 |
| 2007/0079433 | A1 * | 4/2007 | Juneau | E04H 4/14 4/492 |
| 2009/0100587 | A1 * | 4/2009 | Smith | E04H 4/14 297/14 |
| 2011/0099708 | A1 * | 5/2011 | Freedman | A47C 15/004 4/496 |
| 2013/0037665 | A1 * | 2/2013 | Brasell | E04H 4/14 248/205.6 |
| 2020/0149570 | A1 * | 5/2020 | Huang | F16B 7/0486 |

* cited by examiner

POOLSIDE CADDY

RELATED APPLICATIONS

None.

FIELD OF THE INVENTION

The present invention relates generally to a cupholder and more specifically to a poolside cupholder.

BACKGROUND OF THE INVENTION

Very few leisure time activities rival that of spending a warm summer day in the water. Many of us get our exposure to water in a backyard inground pool. The feel of water all over our bodies seems to make troubles melt away, all while in a relaxed state having fun. Due to the length of time that many of us spend in the water, access to personal items such as beverages and cell phones is typically desired.

While such items can be balanced on the edge of the pool, it is only a matter of time before such items get spilled, knocked over, or fall in the water or get wet from splashed water. This can obviously turn a fun time into a costly disaster, ruining anyone's day. Accordingly, there exists a need for a means by which personal items can be easily accessed while in an inground pool but remain protected from accidental exposure to the water. The development of the poolside cupholder fulfills this need.

SUMMARY OF THE INVENTION

The inventor has recognized the aforementioned inherent problems and lack in the art and observed that there is a need for a poolside caddy has an enclosure which has a first arm with a top surface and a bottom surface, a second arm with a top, a bottom, a front surface, and a rear surface, and a hollow interior, one or more cup holders which have one or more round depressions disposed on the top surface of the first arm, and one or more phone holders which have one or more rectangular depressions which are disposed on the top surface of the first arm.

The first arm may be adapted to rest on top of a patio surrounding an inground pool. The top of the rear surface of the second arm may include an inset such that the poolside caddy fits around a coping disposed on an edge of the inground pool. The second arm may extend downward along a pool side wall. The front surface of the second arm may be curved such that the bottom of the second arm tapers in towards the pool side wall and the top of the second arm bows outward before aligning with the top surface of the first arm. The enclosure may have a consistent lateral width. The top surface and the bottom surface of the first arm may be planar and may be horizontally oriented.

The rear surface of the second arm may be planar and vertically oriented. The enclosure may be L-shaped. The hollow interior may be filled to give the enclosure weight that prevents the enclosure from moving. The enclosure may be weighted by filling the hollow interior with water. The enclosure may be weighted by filling the hollow interior with sand. The enclosure may include a fill aperture. The fill aperture may be covered by a fill plug when not being filled or emptied. The enclosure may include a non-slip surface to reduce the enclosure from sliding. The non-slip surface may be made of natural rubber. The non-slip surface may be made of synthetic rubber. The enclosure may be made of plastic. The one or more cup holders may extend down into the enclosure and each have a horizontal bottom such that a beverage container is adapted to be placed into each of the one or more cup holders and are supported from tipping. The one or more phone holders may extend down into the enclosure and each have the horizontal bottom such that the one or more personal electronic devices are placed into the one or more phone holders to prevented from falling.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
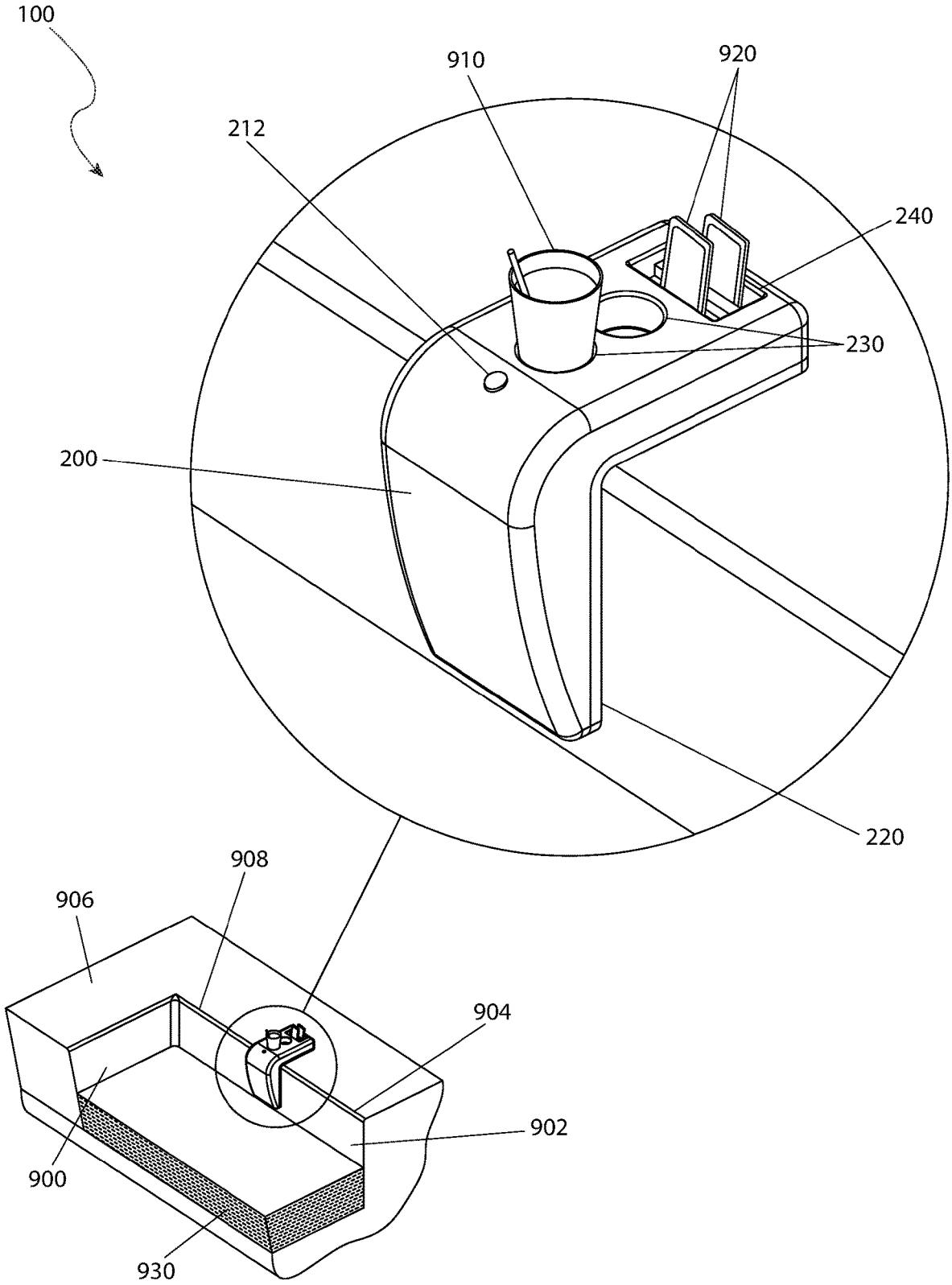
FIG. 1 is an in-use view of a poolside caddy, according to an embodiment of the present invention.
Figure 2:
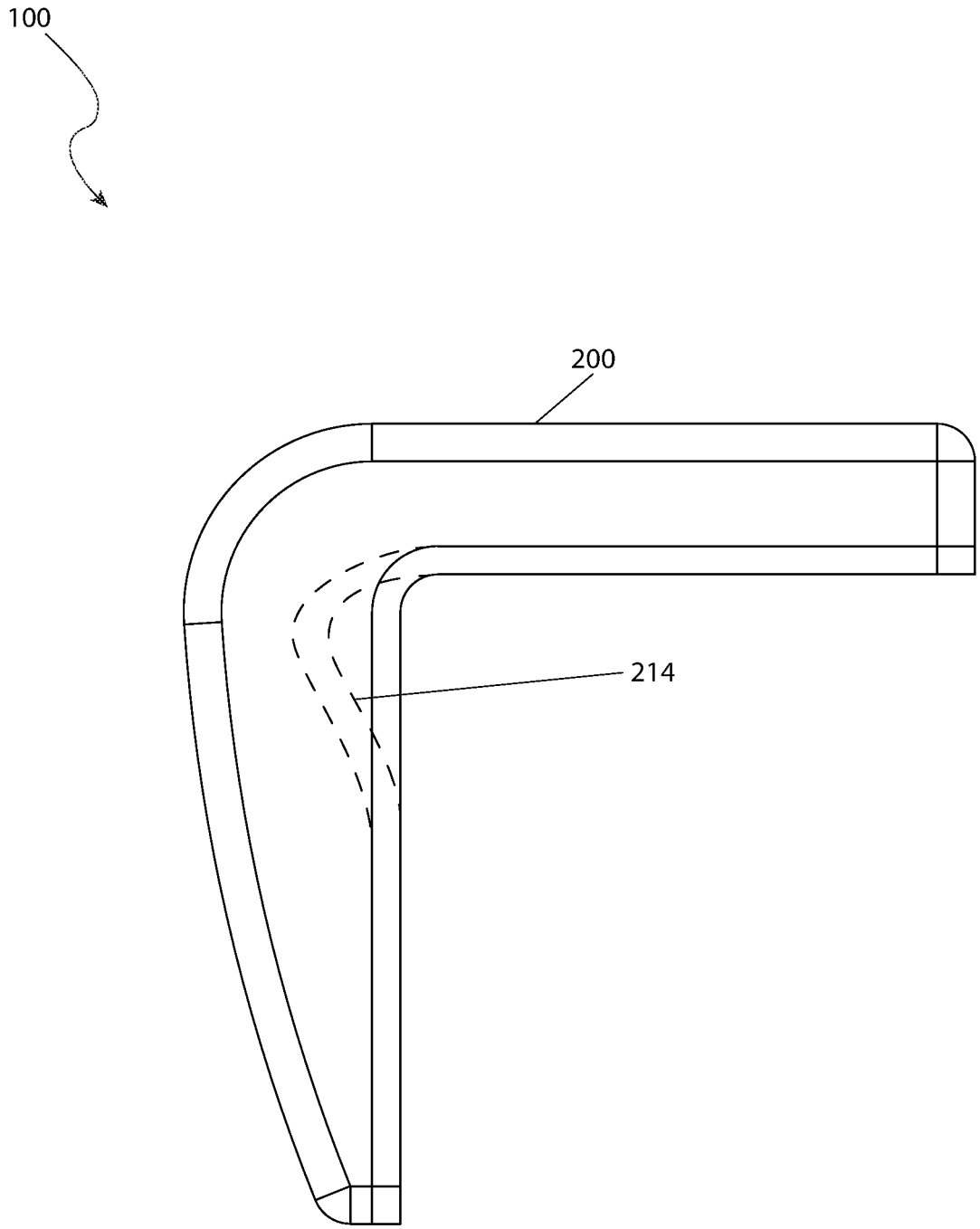
FIG. 2 is a side view of a poolside caddy, according to an embodiment of the present invention.
Figure 3:
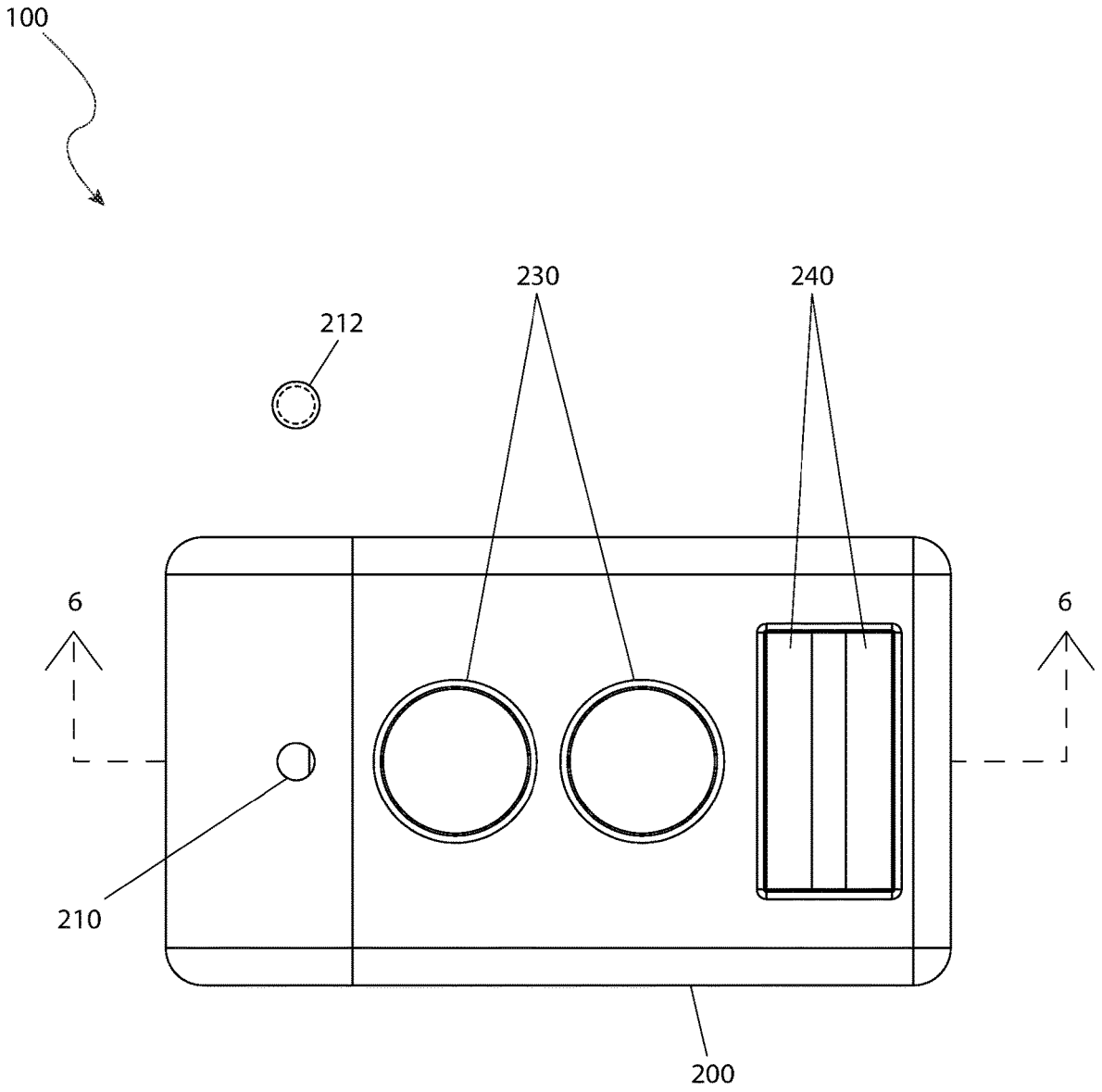
FIG. 3 is a top view of a poolside caddy, according to an embodiment of of the present invention.
Figure 4:
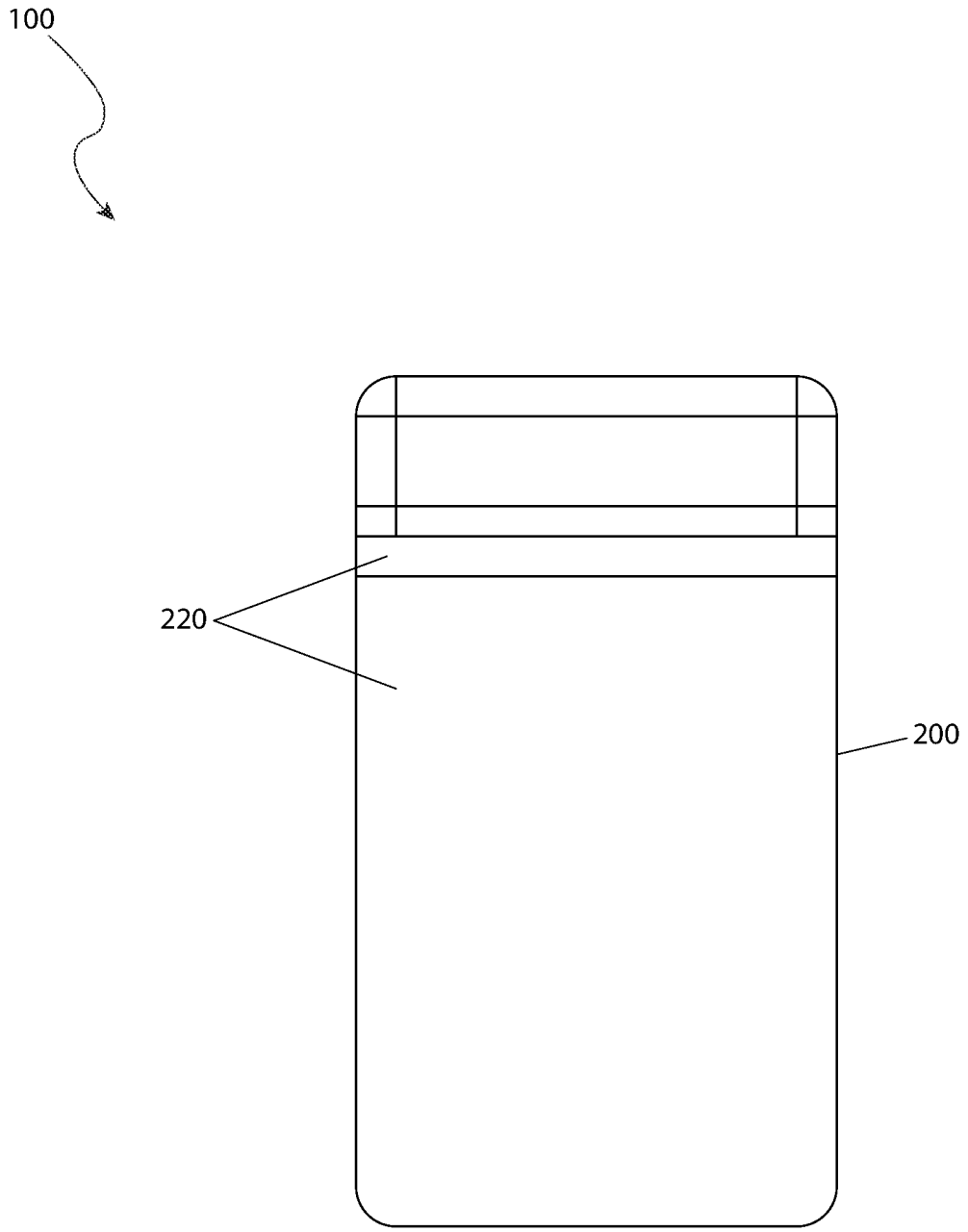
FIG. 4 is a rear view of a poolside caddy, according to an embodiment of the present invention.
Figure 5:
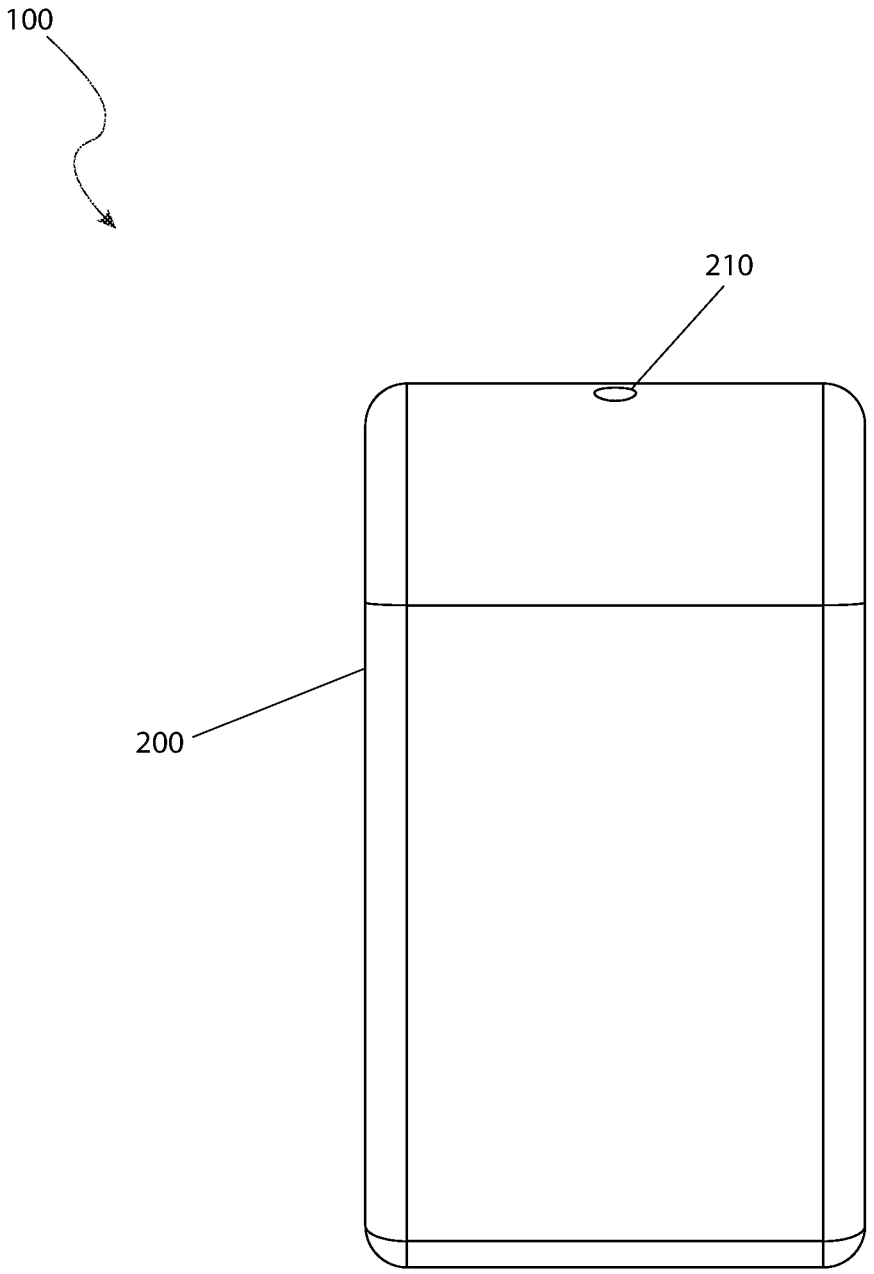
FIG. 5 is a front view of a poolside caddy, according to an embodiment of the present invention.
Figure 6:
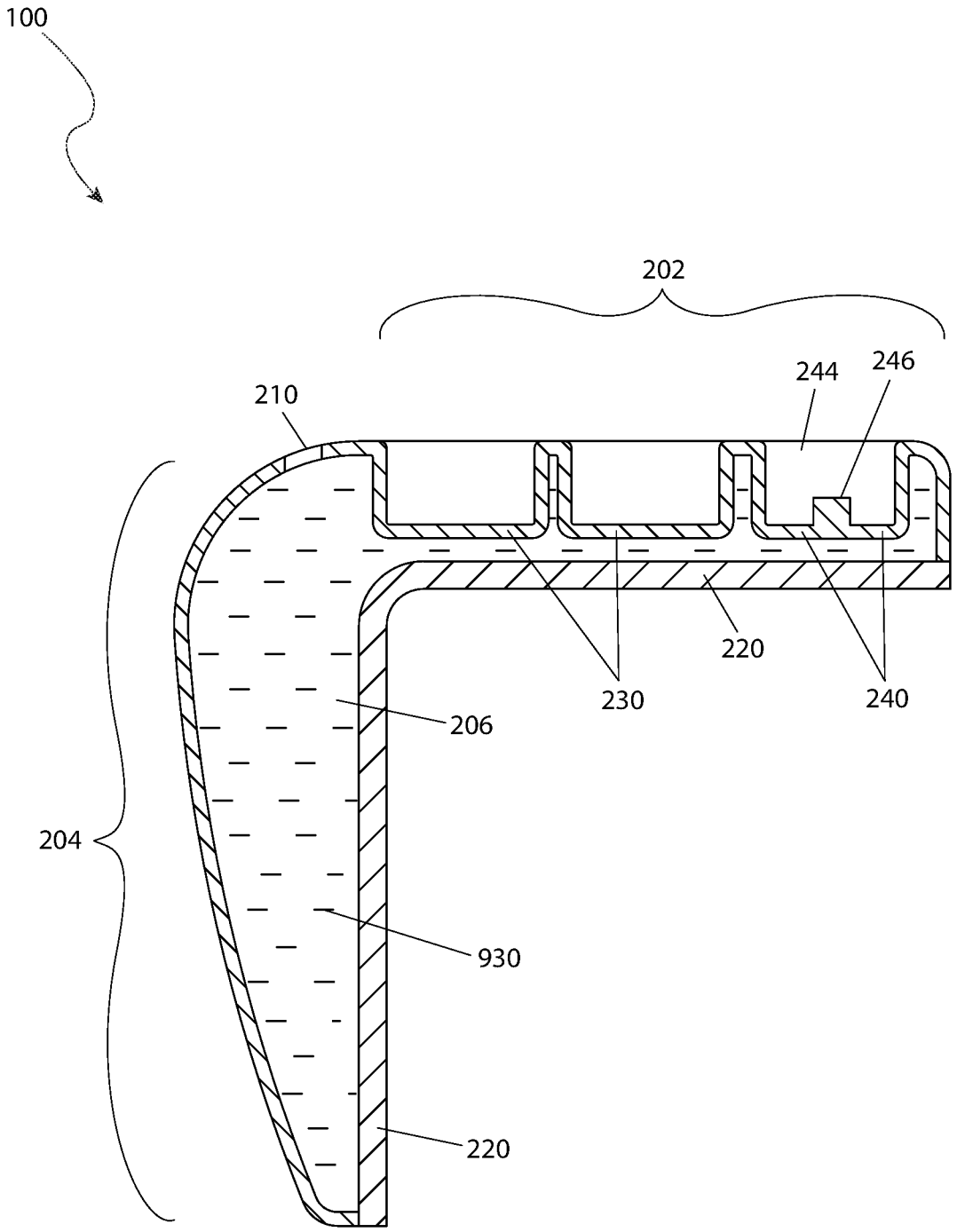
FIG. 6 is a cross-sectional view of a poolside caddy, according to an embodiment of the present invention, across Line 6-6 as shown in FIG. 3.

100 poolside caddy
200 enclosure
202 first arm
204 second arm
206 hollow interior
210 fill aperture
212 fill plug
214 inset
220 non-slip surface
230 cup holder
240 phone holder
244 single depression
246 dividing wall
900 inground pool
902 pool side wall
904 coping
906 patio
908 edge
910 beverage container
920 personal electronic device
930 water

DESCRIPTION OF THE INVENTION

The present invention is directed to a poolside caddy (herein described as the "invention") 100. The invention 100 may comprise an enclosure 200, one (1) or more cup holders 230, and one (1) or more phone holders 240. The invention 100 may be a container for holding one (1) or more beverage containers 910, one (1) or more personal electronic devices 920, or both at a poolside venue. The invention 100 may be placed at an edge 908 of an inground pool 900 where the one (1) or more beverage containers 910 and the one (1) or more personal electronic devices 920 may be adapted to be accessible by a user while the user is in the inground pool 900. The invention 100 may be configured to prevent the one (1) or more beverage containers 910 and the one (1) or more personal electronic devices 920 from being knocked into the inground pool 900. The invention 100 may be weighted to prevent movement.

The enclosure 200 may be L-shaped when viewed from the side, with a first arm 202 that rests on top of a patio 906 surrounding the inground pool 900 and a second arm 204 that extends downward along a pool side wall 902. The enclosure 200 may be a consistent lateral width from top to bottom. The top and bottom surface of the first arm 202 may be planar and may be horizontally oriented. The rear surface of the second arm 204 may be planar and may be vertically oriented. The front surface of the second arm 204 may be curved such that the bottom of the second arm 204 tapers in towards the pool side wall 902 and the top bows outward before aligning with the top surface of the first arm 202.

The enclosure 200 may comprise a hollow interior 206. The hollow interior 206 may be filled to give the enclosure 200 weight that may prevent the enclosure 200 from moving. As non-limiting examples, the enclosure 200 may be weighted by filling the hollow interior 206 with water 930 or sand.

The hollow interior 206 may be filled or emptied via a fill aperture 210. As a non-limiting example, the fill aperture 210 may be located on the top front of the enclosure 200. The fill aperture 210 may be covered by a fill plug 212 when not being filled or emptied.

In some embodiments, the top of the rear surface of the second arm 204 may comprise an inset 214 such that the invention 100 may fit around a coping 904 located at the edge of the inground pool 900.

The enclosure 200 may comprise a non-slip surface 220 to reduce the likelihood of the enclosure 200 sliding. The non-slip surface 220 may be coupled to the bottom of the first arm 202, the rear of the second arm 204, or both.

The cup holders 230 may be one (1) or more round depressions located on the top surface of the first arm 202. The cup holders 230 may extend down into the enclosure 200 and may have horizontal bottoms such that the beverage containers 910 placed into the cup holders 230 may be supported from tipping. As non-limiting examples, the beverage containers 910 may comprise cups, bottles, wine glasses, or any combination thereof.

The phone holders 240 may be one (1) or more rectangular depressions located on the top surface of the first arm 202. The phone holders 240 may extend down into the enclosure 200 and may have horizontal bottoms such that the one (1) or more personal electronic devices 920 placed into the phone holders 240 may be prevented from falling into the inground pool 900. As non-limiting examples, the personal electronic devices 920 may comprise phones, tablet computers, handheld video games, or any combination thereof.

In some embodiments, the phone holders 240 may take the form of a single depression 244 that is partitioned by a dividing wall 246. The single depression 244 may rise from the bottom surface of the single depression 244 to a height that is below the height of the top surface of the first arm 202. The single depression 244 may be laterally oriented and may partition the single depression 244 into two (2) equally sized sub-depressions.

As non-limiting examples, the enclosure 200 may be made of plastic and the non-slip surface 220 may be made of natural or synthetic rubber.

In use, the hollow interior 206 of the enclosure 200 may be filled with water 930 or sand by removing the fill plug 212, pouring the water 930 or the sand in through the fill aperture 210, and replacing the fill plug 212. The enclosure 200 may be positioned at the edge 908 of the inground pool 900 with the bottom of the first arm 202 on the patio 906 and the rear surface of the second arm 204 pressed against the pool side wall 902. The beverage containers 910 may be placed into the cup holders 230, the personal electronic devices 920 may be placed into the phone holders 240, or both.

The exact specifications, materials used, and method of use of the invention 100 may vary upon manufacturing. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A poolside caddy, comprising:

an enclosure having a first arm with a top surface and a bottom surface, a second arm with a top, a bottom, a front surface, and a rear surface, and a hollow interior;

one or more cup holders having one or more round depressions disposed on the top surface of the first arm;

one or more phone holders having one or more rectangular depressions disposed on the top surface of the first arm and, wherein the hollow interior is filled to give the enclosure weight that prevents the enclosure from moving;

wherein the enclosure is weighted by filling the hollow interior with a quantity of a weighted substance;

wherein the enclosure includes a fill aperture; and, wherein the fill aperture is covered by a fill plug when not being filled or emptied.

2. The poolside caddy, according to claim 1, wherein the first arm is adapted to rest on top of a patio surrounding an inground pool.

3. The poolside caddy, according to claim 2, wherein the top of the rear surface of the second arm includes an inset such that the poolside caddy fits around a coping disposed on an edge of the inground pool.

4. The poolside caddy, according to claim 1, wherein the second arm extends downward along a pool side wall.

5. The poolside caddy, according to claim 4, wherein the front surface of the second arm is curved such that the bottom of the second arm tapers in towards the pool side wall and the top of the second arm bows outward before aligning with the top surface of the first arm.

6. The poolside caddy, according to claim 1, wherein the enclosure has a consistent lateral width.

7. The poolside caddy, according to claim 1, wherein the top surface and the bottom surface of the first arm are planar and are horizontally oriented.

8. The poolside caddy, according to claim 1, wherein the rear surface of the second arm is planar and vertically oriented.

9. The poolside caddy, according to claim 1, wherein the enclosure is L-shaped.

10. The poolside caddy, according to claim 1, wherein the enclosure includes a non-slip surface to reduce the enclosure from sliding.

11. The poolside caddy, according to claim 10, wherein the non-slip surface is made of natural rubber.

12. The poolside caddy, according to claim 10, wherein the non-slip surface is made of synthetic rubber.

13. The poolside caddy, according to claim 1, wherein the enclosure is made of plastic.

14. The poolside caddy, according to claim 1, wherein the one or more cup holders extend down into the enclosure and each have a horizontal bottom such that a beverage container is adapted to be placed into each of the one or more cup holders and are supported from tipping.

15. The poolside caddy, according to claim 14, wherein the one or more phone holders extend down into the enclosure and each have the horizontal bottom such that the one or more personal electronic devices are placed into the one or more phone holders to prevented from falling.

* * * * *